US011388790B1

(12) United States Patent
Kraft et al.

(10) Patent No.: US 11,388,790 B1
(45) Date of Patent: Jul. 12, 2022

(54) SELF-REPAIRING LIGHT BULB AND METHOD

(71) Applicants: Daniel John Kraft, Sparks, NV (US); Inez Dorothey Kraft, Sparks, NV (US)

(72) Inventors: Daniel John Kraft, Sparks, NV (US); Inez Dorothey Kraft, Sparks, NV (US)

( * ) Notice: Subject to any disclaimer, the term of this patent is extended or adjusted under 35 U.S.C. 154(b) by 0 days.

(21) Appl. No.: 17/402,091

(22) Filed: Aug. 13, 2021

(51) Int. Cl.

| | |
|---|---|
| ***H05B 47/10*** | (2020.01) |
| ***H05B 45/12*** | (2020.01) |
| ***H05B 47/23*** | (2020.01) |
| ***H05B 45/54*** | (2020.01) |
| ***G08B 5/36*** | (2006.01) |

(52) U.S. Cl.
CPC ..... *H05B 45/12* (2020.01); *G08B 5/36* (2013.01); *H05B 45/54* (2020.01); *H05B 47/23* (2020.01)

(58) Field of Classification Search
CPC ..... H05B 45/20; H05B 45/30; H05B 45/50; H05B 47/105; H05B 47/155; H05B 47/165; H05B 47/185; H05B 47/195
See application file for complete search history.

(56) References Cited

U.S. PATENT DOCUMENTS

| | | | |
|---|---|---|---|
| 1,641,068 | A | 8/1927 | Czech |
| 3,886,400 | A | 5/1975 | Dill |
| 4,287,452 | A | 9/1981 | Fernandez, III |
| 4,447,760 | A | 5/1984 | Koo |
| 4,580,079 | A | 4/1986 | Koo |
| 4,841,196 | A | 6/1989 | Waymouth |
| 5,061,879 | A | 10/1991 | Munoz et al. |
| 6,127,772 | A | 10/2000 | Carlson |
| 6,278,382 | B1 | 8/2001 | DeMarco et al. |
| 6,583,540 | B2 | 6/2003 | Al-Refai |
| 7,423,717 | B2 | 10/2008 | Frederick et al. |
| 8,749,142 | B2 | 6/2014 | Nguyen et al. |
| 9,370,071 | B2 | 6/2016 | Wiscombe et al. |
| 9,784,417 | B1 * | 10/2017 | Springer ..... F21V 23/006 |
| 10,251,242 | B1 * | 4/2019 | Rosen ..... H05B 47/19 |
| 10,260,685 | B2 * | 4/2019 | Bernard ..... F21K 9/237 |
| 11,248,752 | B2 * | 2/2022 | Halliwell ..... F21K 9/65 |

(Continued)

FOREIGN PATENT DOCUMENTS

| | | |
|---|---|---|
| CN | 2107065 U | 6/1992 |
| GB | 2434029 | 7/2007 |
| WO | WO2017180176 | 10/2017 |

*Primary Examiner* — Tung X Le
(74) *Attorney, Agent, or Firm* — John D. Long, Esq.; Long & Chybik

(57) ABSTRACT

The invention is a self-repairing light bulb and method for same, the self-repairing light bulb comprises a light bulb body forming a hollow interior for containing a set of illumination arrays, one or more light detectors to detect a set minimum level of illumination as issued from an energized illumination array, light analyzers connected to one or more light detectors and configured to activate a programmable electro-mechanical controller when a selected and currently energized illumination array fails to provide the set minimum level of illumination, the programmable electro-mechanical controller configured to energize one illumination array at a time from the set of illumination arrays in a set sequential pattern, further comprising a last illumination array energization warning system that is activated when a last-in-sequence illumination array of the set is energized.

20 Claims, 4 Drawing Sheets

(56) References Cited

U.S. PATENT DOCUMENTS

| | | | | |
|---|---|---|---|---|
| 2008/0106893 | A1* | 5/2008 | Johnson | H05B 45/20 362/228 |
| 2008/0304249 | A1 | 12/2008 | Davey et al. | |
| 2012/0086345 | A1* | 4/2012 | Tran | H05B 47/115 315/158 |
| 2012/0218748 | A1* | 8/2012 | Conrad | F21K 9/23 362/230 |
| 2013/0205626 | A1 | 8/2013 | Hu | |
| 2015/0091451 | A1* | 4/2015 | Williams | H01R 33/9453 315/160 |
| 2016/0330825 | A1* | 11/2016 | Recker | H05B 45/20 |
| 2017/0019973 | A1* | 1/2017 | Beck | H05B 45/42 |

* cited by examiner

SELF-REPAIRING LIGHT BULB AND METHOD

STATEMENT REGARDING FEDERALLY SPONSORED RESEARCH OR DEVELOPMENT

Not Applicable

REFERENCE TO A "MICROFICHE APPENDIX"

Not Applicable.

FIELD OF THE INVENTION

The present invention may relate to illumination devices such as self-repairing light bulbs that have multiple illumination sources. More specifically, the present invention may relate to those self-repairing light bulbs whose multiple illumination sources may be sequentially energized to restore the self-repairing light bulb's illumination capability when the self-repairing light bulb's currently activated illumination source no longer functions to provide illumination.

BACKGROUND

Since the commercially successful introduction of the incandescent light bulb there have been various attempts to prolong the illumination life of the light bulb. Some attempts have focused on an incandescent light bulb having multiple filaments that move the energization pathway from a non-performing filament to a redundant performing filament either manually or automatically. These self-repairing light bulbs could find their greatest appreciation when placed in high, hard-to-reach or both, light fixtures.

A manually operating self-repairing light bulb could utilize a hand-operated switch accessible on the outside of the bulb to allow the bulb operator to switch energization from one filament to another filament. An example of an automatically self-repairing light bulb could use interconnected wiring in a manner that could allow a break in an initially operating filament (e.g., due to the filament wearing out during operation) to sequentially energize another filament to continue the illumination of the light bulb.

In more recent times, the self-repairing light bulbs have moved from filament light sources onto solid state illumination sources such as LEDs or Light Emitting Diodes which have increased light emission capability while reducing power consumption. This self-repairing light bulb development has generally allowed for solid state and integrated circuitry capabilities to sequentially energize light emitting sources of self-repairing bulb to restore bulb light emissions when the previously operating light emitting source fails.

One possible issue in sequential lighting operations of self-repairing light bulbs may be a lack of any indicator system to inform the bulb operator that the self-repairing light bulb's last light emitting source has been activated, generally indicating that the self-repairing light bulb replacement, refurbishment or both may be needed in due course (while the self-repairing light bulb is still illumination capable.)

What could be needed is the present invention, a self-repairing light bulb with a warning indicator (e.g., a last LED array activation alert system.) One possible embodiment of the self-repairing light bulb could utilize sequentially activated set of light emitting sources (e.g., LED arrays) that when the currently energized LED array fails produce a proper light output for the self-repairing light bulb then that LED array is then de-energized with the next-in-sequence or order LED array being energized. When the last-in-sequence LED array is energized, the warning indicator could be activated to generally inform an operator that last-in-sequence LED array is energized and that the self-repairing light bulb should be replaced, refurbished or both. In one possible embodiment of the invention, the warning indicator could be a light source (e.g., a colored LED) located on a body of the self-repairing repairing light bulb that is separate and apart from the set of LED arrays.

SUMMARY OF ONE EMBODIMENT OF THE INVENTION

Advantages of One or More Embodiments of the Present Invention

The various embodiments of the present invention may, but do not necessarily, achieve one or more of the following advantages:

the ability to sequentially energization of a set of illumination sources of a self-repairing light bulb and to indicate to an operator when the last-in-sequence or order illumination source is energized;

to provide an operator alert system that a self-repairing light bulb needs to be replaced prior to self-repairing light bulb burning out;

the ability to determine that a self-repairing light bulb is reaching the end of its useful life and to allow for timely replacement, refurbishment, or both;

to provide a programmable electrical mechanical controller with an electrical geared motor that sequentially energizes a set of illumination sources of a self-repairing light bulb;

the ability to use light detection to sequentially energized multiple illumination sources of is a self-repairing light bulb;

to provide a fan system for self-repairing light bulb to vent heat generated by a sequentially activated set of multiple illumination sources; and the ability to filter out blue light emanating from sequentially energized multiple illumination sources of a self-repairing light bulb.

These and other advantages may be realized by reference to the remaining portions of the specification, claims, and abstract.

Brief Description of One Embodiment of the Present Invention

One possible embodiment of the invention could be a self-repairing light bulb comprising: a light bulb body forming a hollow interior for containing a set of illumination arrays, one or more light detectors, one or more light analyzers, a programmable electro-mechanical controller and last illumination array warning system; the set of illumination arrays wherein each illumination array of the set of illumination arrays comprises several light sources clustered together; the one or more light detectors to detect a set minimum level of illumination as issued energized self-repairing light bulb; one or more one light analyzers configured to activate the programmable electro-mechanical controller when the currently energized illumination array fails to provide the set minimum level of illumination; a programmable electro-mechanical controller configured to energize one illumination array at a time from the set of illumination arrays in a set sequential pattern when the programmable electro-mechanical controller is activated by at least one light analyzer; and a last illumination array warning system that is activated when a last-in-sequence illumination array is energized from the set of illumination arrays.

Another possible embodiment of the invention could a method of operating a self-repairing light bulb comprising the following steps: providing a self-repairing light bulb comprising a light bulb body forming a hollow interior for containing a set of illumination arrays, a set of light detectors, a light analyzer, a programmable electro-mechanical controller and a last illumination array warning system, wherein each light detector is electrically connected to the light analyzer; the light analyzer electrically connects to a geared motor of the programmable electro-mechanical controller that operates a rotational electrical switch, rotational electrical switch further electrically connects to the set of illumination arrays; detecting less than a set minimum amount of illumination from the set of illumination arrays; activating the light analyzer to energize the geared motor; moving the rotational arm of the rotational electrical switch to energize one illumination array of the set of illumination arrays at a time in a sequential pattern; and activating the last illumination array warning system when the last-in-sequence illumination array is energized.

The above description sets forth, rather broadly, a summary of one embodiment of the present invention so that the detailed description that follows may be better understood and contributions of the present invention to the art may be better appreciated. Some of the embodiments of the present invention may not include all the features or characteristics listed in the above summary. There are, of course, additional features of the invention that will be described below and will form the subject matter of claims. In this respect, before explaining at least one preferred embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

DESCRIPTION OF CERTAIN EMBODIMENTS OF THE PRESENT INVENTION

Figure 1:
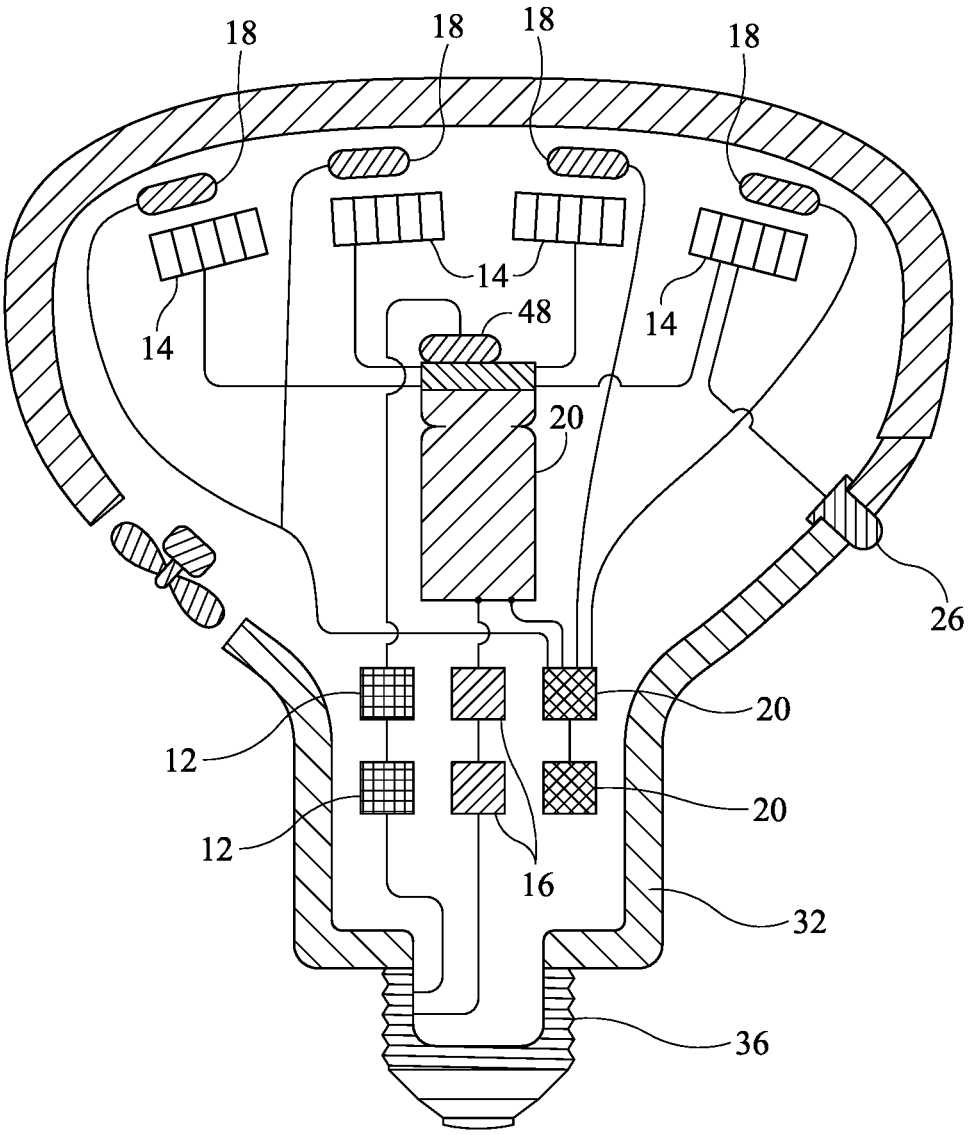
FIG. 1 is substantially an elevation cutaway of the invention

In the following detailed description of the preferred embodiments, reference is made to the accompanying drawings, which form a part of this application. The drawings show, by way of illustration, specific embodiments in which the invention may be practiced. It is to be understood that other embodiments may be utilized and structural changes may be made without departing from the scope of the present invention.

The present invention 10 could comprise a self-repairing light bulb 30 having a set of light emission sources (e.g., LED arrays 14) that may be sequentially activated in relation to a previously selected, energized LED array's failure to provide a predetermined level of light emission when energized and a method of operating same 100. The self-repairing light bulb 30 could further comprise a warning indictor (e.g., a last LED array activation alert system 26) that could be used to notify an operator as to when last-in-sequence LED array 14 has been selected and energized to allow the operator to generally plan for the light bulb's replacement or repair.

As substantially shown in FIG. 1, the invention 10 could comprise one or more LED drivers 12, more than one light illumination source or LED arrays 14, one or more 12-volt power adapters 16, more than one light detector 18, one or more light analyzers 20, programmable electro-mechanical controller 22, one or more DC fans 24 and a last LED array activation alert system 26. These components could be housed within and be supported by a hollow interior 28 as formed by the light bulb body 32. A transparent section 34 of the light bulb body 32 could allow the illumination generated by the currently selected and energized LED array 14 of the more than one LED arrays 14 to pass through and out from the light bulb body 32 to an exterior environment 2. A conductive base 36 of the light bulb body 32 could be configured in a manner very well known in the art to be electrically connected the LED driver(s) 12 and 12-volt power adapter(s) 16. The conductive base 36 could be removably connected (e.g., removably inserted into an appropriate light socket-not shown) to an outside electrical power source (e.g., household current of 120 volts and 20-15 amps) to provide sufficient power for the invention 10.

Figure 2:
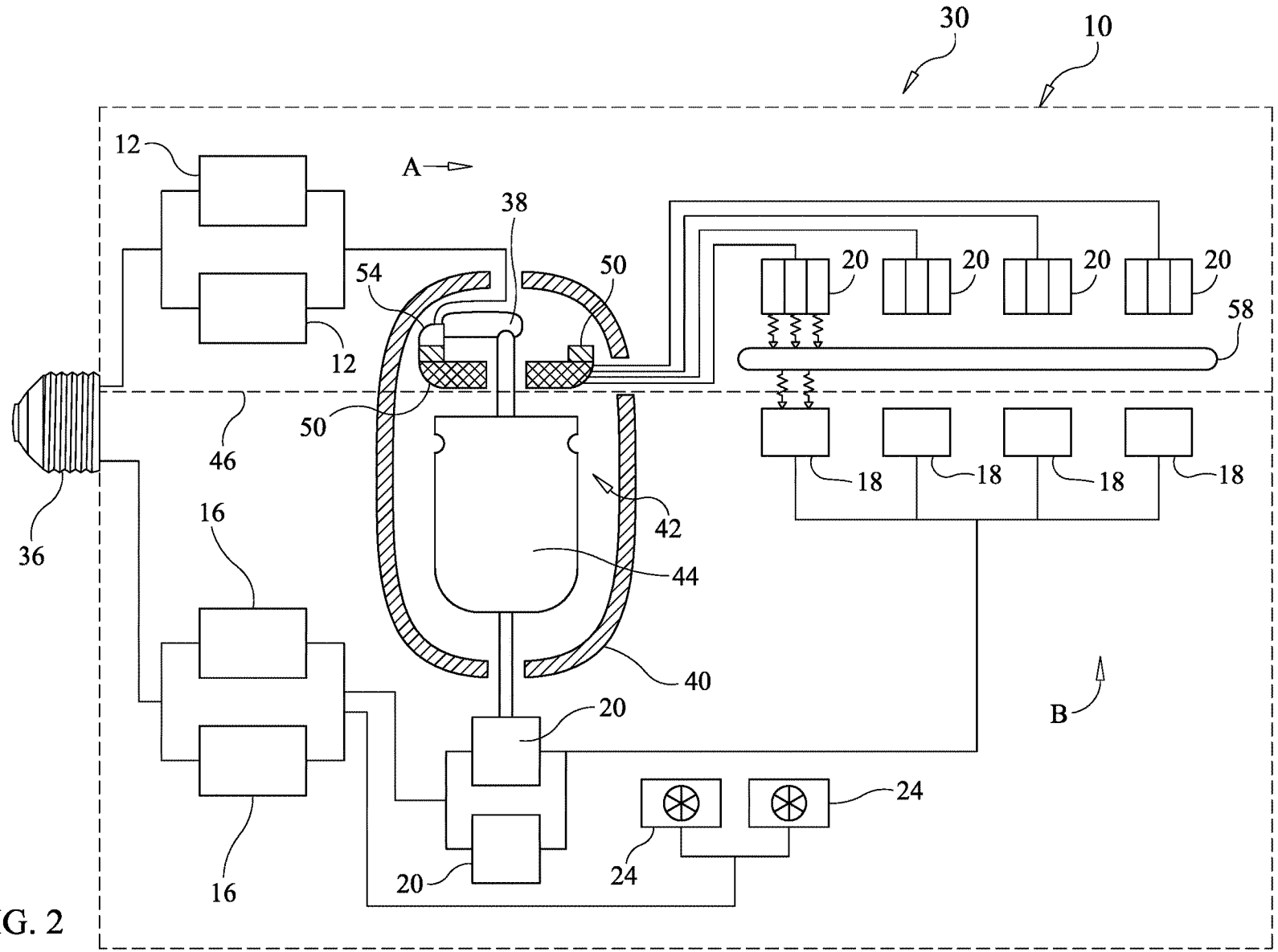
FIG. 2 is substantially a schematic view of one embodiment of the invention.

As substantially shown in FIG. 2, the invention 10 in one embodiment could have two electrical circuits, a first or illumination circuit A for providing power to the sequentially selected LED Array 14 and a second or sequential circuit B for controlling the electrical components used in sequencing the operation of the LED arrays 14. The first or illumination circuit A may need a higher voltage to substantially power the sequentially selected LED arrays 14 in comparison to the second or sequential circuit B which may use a lower voltage (e.g., 12 volts) to generally run the programmable electro-mechanical controller 22 and the remaining electrical components. In another embodiment (not shown), the invention 10 could have just one circuit with all the electrical components being selected wherein the electrical components could run on the same electrical current.

The first or illumination circuit A could comprise at least one LED driver 12 (e.g., additional LED drivers 12 could be used in with a driver switch circuit to provide a system power redundancy), a rotational electrical switch portion 38 of the programmable electro-mechanical controller 22, a set of LED arrays 14 (each LED array 14 could comprise a set or cluster of electrically connected LEDs—not shown) and the last LED array activation alert system 26. The LED driver 12 could transform the incoming household voltage/current to the incoming power requirements of the set of LED arrays 14 (e.g., substantially converting the household current from AC [Alternating Current] to DC [Direct Current], generally reducing voltage from 120 volts to 36 volts and generally reducing current from 15 Amps to 600 Milliamps.) The LED driver 12 could direct the altered household voltage/current to the programmable electro-mechanical controller's rotation electrical switch 38 and onto the selected LED array 14.

Figure 3:
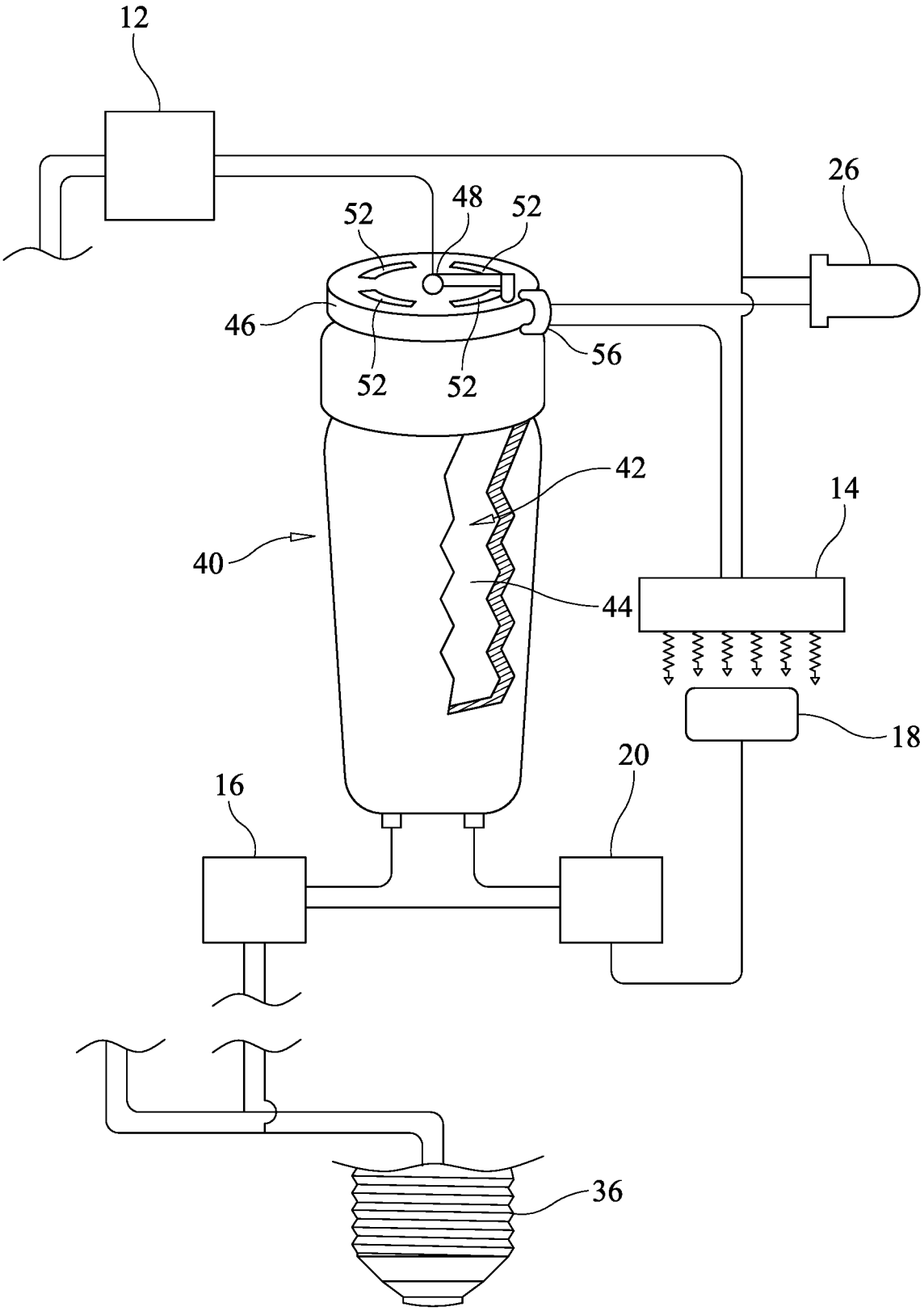
FIG. 3 is substantially a perspective cutaway of one embodiment of the programmable electro-mechanical controller of the invention.

As shown in FIG. 3, the programmable electro-mechanical controller 22 could comprise a controller body 40 generally forming a controller hollow interior 42 that substantially supports an electrical geared motor 44. The electrical geared motor 44 when energized mechanically powers the rotational electrical switch 38 as seated on top of the electrical geared motor 44. The rotational electrical switch 38 could comprise a tracked disc 46 and a rotational arm 48. The rotational arm 48 could be electrically connected to and be powered by the LED driver 12. The rotational arm 48 could be further rotated about the tracked disc 46 by the electrical geared motor 44 whose shaft (not shown). The shaft may movably rotate through the center of the tracked disc 46 to substantially connect at a non-electrical tip end of the rotational arm 48 to rotate the rotational arm 48 about the non-electrical tip end. The tracked disc 46 could further comprise an intermittent circular electrical track 50 generally running along a circumference of the tracked disc 46. The intermittent circular electrical track 50 could comprise multiple track sections 52 with each track section 52 being electrically isolated from the other track sections 52 and each track section 52 being electrically connected to a respective LED array 14. The electrically conductive tip 54 of the rotational arm 48 could be electrically connected to the LED driver(s) 12 and as the second or sequential circuit B, (the light analyzer[s] 20) energizes the electro-mechanical controller's electrical geared motor 44, the electrical geared motor 44 could the rotate the rotational arm 48. As the rotational arm 48 rotates, the electrically conductive tip 54 moves along the disc track 54 to sequentially energize the LED arrays 14. As the rotational arm 48 comes to rest of upon specific track section 52 (de-energizing of the electrical geared motor 44) to substantially allows the energization of the respective LED array 14 when the self-repairing light bulb 30 is energized. The LED arrays' ground/neutral could return to the LED driver(s) 12 to substantially complete the first or illumination circuit A.

Other electrical devices could be connected to various track sections 52 to first or illumination circuit A obtain power during operation as needed. In this manner a C-shaped electrical connector 56 could be attached to the circumference edge of the tracked disc 46 to connect a specific track section 52 to another electrical device besides an LED array 14. For example, the Last LED array activation alert system 26 could be attached to the track section 52 that powers the last-in-sequence or end LED array 14. In another embodiment, last LED array activation alert system 26 could be directly electronically connected to the end or the last-in-sequence LED array 14 rather than being directly connected to the respective track section 52.

In either embodiment, when the end or the last-in-sequence LED array 14 is energized, the last LED array activation alert system 26 could be energized as well.

The last LED array activation alert system 26 could comprise one or more LED(s) (e.g., colored LEDs) that are so configured to be seen by a self-repairing light bulb operator (not shown) when the last LED array 14 in the sequential energization order is activated and provides illumination. The last LED array activation alert system's light emission (distinguishable from the activated LED arrays' illumination) could then inform the operator (not shown) that the last LED array 14 in sequential energization order is energized and that a light bulb maintenance protocol should be implemented for the self-repairing light bulb removal and replacement in a timely manner (e.g., while the self-repairing light bulb 30 can still provide illumination.)

In other embodiments of the invention 10 wherein the self-repairing light bulb 30 can be disassembled and the worn-out electrical components may be replaced, the self-repairing light bulb 30 could be removed from the light socket, refurbished and then replaced into its respective light bulb socket for further illumination operations.

The second or sequential circuit B (e.g., as substantially shown in FIG. 2) could comprise one or more 12-volt DC adapters 16 (e.g., the DC power adapters 16 may be connected by a selection circuit to alternate between DC power adapters 16 to provide system redundancy), programmable electro-mechanical controller 22, one or more light analyzers 20 (e.g., multiple light analyzer 20 may be connected in parallel to provide system redundancy), one or more light detectors 18, and a final LED alert system 26. The same household current as supplied to the LED driver(s) 12 could be provided to the 12-volt DC (direct current) power adapter 16 to convert the household current from AC (Alternating Current) to DC (Direct Current), drop household voltage from 120 volts to 12 volts and drop current from 15 amps down to 600 milliamps for second or sequential circuit power needs.

The second or sequential circuit B could connect the 12-volt DC adapter(s) to the one or more light detectors 18 wherein a light detector 18 (e.g., a photoresistor, photocell, photodiode, phototransistor or the like) could be assigned to a respective LED array 14 and be positioned so that respective LED array's issuing illumination or light (e.g., photons) could be directed to a light sensitive portion of the respective light detector 18. The activated LED array's illumination (e.g., light or photons) passing onto the photoresistor could lower the resistance of the photoresistor allowing a flow of electrical current from the 12-volt DC adapter(s) to pass through the photoresistor and on the light analyzer 20.

Similarly, when activated LED array's illumination (e.g., light) passes upon the light detector 18, the light detector's associated photoresistor, photocell, photodiode and the like could receive emitted light or photons to generally create or allow an electrical current that could be passed onto the light analyzer(s) 20. In one embodiment, a light detector 18 could be a photoresistor and a photodiode (or like) generally connected in parallel, generally providing system or backup redundancy. The activated LED array's illumination could provide passage, creation or both (e.g., issuance) of an electrical current from the light detector 18 to substantially act as an input signal that is directed to the light analyzer 20. When insufficient or no illumination from the respective activated LED array 14 occurs (e.g., low or no current is directed from the respective light detector 18 to the light analyzer[s] 20) that lack of electrical activity could signal to the light analyzer that currently energized LED array 14 needs to be replaced with the next-in-sequence LED array 14.

In this manner, the light analyzer(s) 20, which could be a relay switch (e.g., electro-mechanical/electrical coil based or solid-state relay switch types), when energized by the light detector 18 will hold open the light analyzer(s) 20 power contacts (not shown) as energized by the 12-volt DC adapter 16. This action could prevent the current from the 12-volt DC adapter from reaching and otherwise energizing the electrical geared motor 44. When current from the respective light detector 18 drops or ceases (e.g., receives low or non-illumination from the associated selected LED array 14) the light analyzer (20) could allow the light analyzer's electrical contacts (not shown) to close and complete the electrical circuit to energize the electrical geared motor 44 to sequentially activate and energized the next-in-line LED array 14. The electrical geared motor 44 may further comprise reduction gearing (not shown) that slows down the speed of the rotating rotational arm 48 which moves the electrically conductive tip 54 along a next track section 52. The tip speed could allow energization of the next-in-sequence LED array 14 to occur fast enough to provide the sufficient illumination for the respective light detector 18 to send the sufficient electrical input to light analyzer 20. This activity could timely open the light analyzer(s) electrical contacts (not shown) to de-energize the electrical geared motor 44 in manner the causes the electrically conductive tip 54 to stay upon on the section track 52 that energizes the next-in sequence LED array 14.

Each light analyzer's input electrical contacts (e.g., as connected to the light detectors 18) could be guarded by a voltage potentiometer (not shown.) This voltage potentiometer could be used to variably set the strength of the input signal from the selected LED array's respective light detector to the level needed to de-activate the light analyzer 20. In setting the minimal input signal strength from the light detector, this could correspondingly set the minimum amount of activated LED array's illumination needed to keep the light analyzer's electrical contacts open and the electrical gear motor depowered. Generally, light detector should be selected, configured or both so that ordinary sunlight or other light bulb's emitted light or other illuminations (e.g., sunlight) would not interfere with light detector's operational function with the parameters of the invention 10.

If one or more of the LED arrays 14 are not operational when the invention 10 has received initial energization, the light analyzer(s) 20 may not receive an appropriate light detector input signal to keep the electrical geared motor 44 depowered. The electrical geared motor could then be powered and sequential LED array energization could continue until a selected and energized LED array 14 illuminates the respective light detector 18 which creates an electrical signal to the light analyzer 20 to the shut down the geared motor 44.

The invention 10 could further comprise a geared motor stopping device (not shown) to preventing the cycling more than once of the rotational electrical switch 38 through the LED array sequential energization order if all the LED arrays 14 had generally been selected, activated and found no longer functional. This stopping device in one embodiment could be geared motor power cutoff or kill switch [not shown] as activated by contact with the rotational arm 48. After one cycle of the LED array sequential energization order, the geared motor power cutoff switch could shut down power to the electrical geared motor to further leave all LED arrays 14 unenergized.

The light analyzer 20 may have a time delay device (not shown) to slow down geared motor activation until the next selected LED array 14 has a chance to issue light (illumination) to next selected LED array's respective light detector 18. This action could prevent momentary energization issues with the light bulb 30 from falsely initiating the electrical geared motor 44 to advance rotational arm 48 to other track sections 52 and through the LED array sequential energization order.

As needed, invention 10, more specifically the second circuit, may further comprise one or more DC fans 24 which can move air (not shown) from the self-repairing light bulb's external environment 2 to the self-repairing light bulb's hollow interior 28 to deal with (e.g., cool off) any heat emanating from the internal electrical componentry of the invention 10. Such ventilation system may restrict the light bulb's usage to inside/protected operative environments in that the fan operation may otherwise allow external environment 2, e.g., rain or other moisture into the light bulb's hollow interior 28 and damage electrical/electronic components entry held within.

In at least one embodiment of the invention 10, the self-repairing light bulb 30 may further comprise a light filter (not shown) configured to prevent the selected LED array 14 from issuing harmful light (e.g., blue light) or other energy (e.g., UV radiation) to external environment 2.

Figure 4:
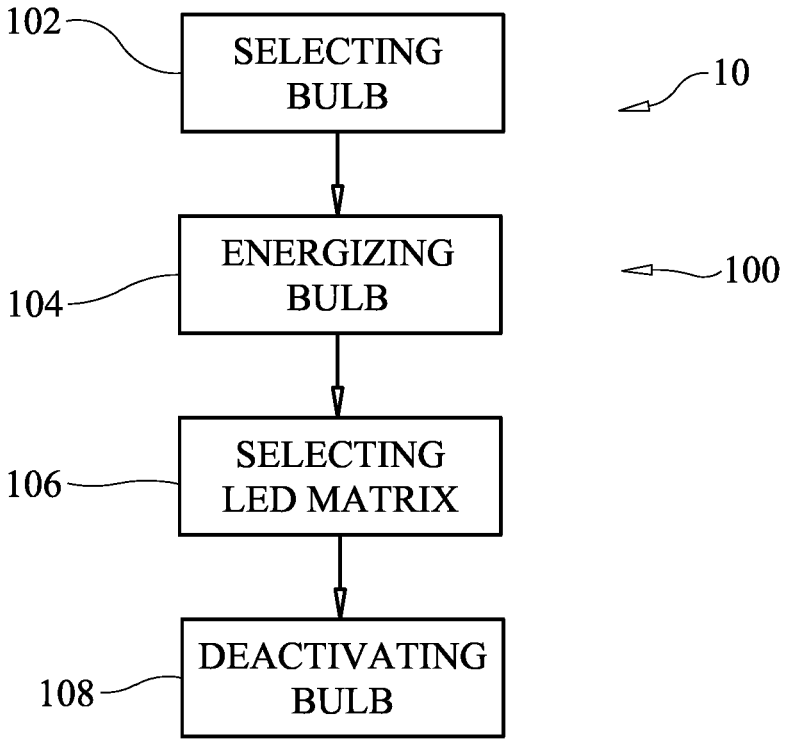
FIG. 4 is a substantially a schematic flowchart for a method or process of operating the invention.

As substantially shown in FIG. 4, another possible embodiment of the invention 10 could be a method or process 100 for operating the light bulb. This method or process 100 could start with step 102 selecting and installing the self-repairing light bulb. The operator could select the self-repairing light bulb based on bulb placement (e.g., high placement and generally not easy to access) and bulb operating environment (e.g., an inside and protective area or outside and exposed area, and the like.) The other bulb selection criteria could include the bulb illumination power to match the lighting requirements of the place being lighted (e.g., a canopy ceiling inside a home vs a ceiling of a larger room such as convention center, factory, or church.)

Once the self-repairing light bulb type and placement is selected, the operator could secure the necessary means to install the self-repairing light bulb. Such installation equipment could include A-frame ladders, bulb installation pole, scissors lift, scaffolding and the like. The operator could then utilize the selected bulb installation equipment to secure the self-repairing light bulb to the desired light socket. Once this step is completed, the process 100 could proceed to the next step 104, energizing the bulb.

In step 104, energizing the bulb, the bulb socket is energized (e.g., household power 102 volts and 15 amps) which is used to energize the circuits A and B simultaneously. In the first illumination circuit A, the LED driver changes the AC household electrical power to DC and reduces the household electrical power to levels suitable to run the LED array as sequentially selected by the operation of the rotation electrical switch. The rotation electrical switch could initially set to energize the first LED array that is first in sequential energization order upon initial light bulb energization. As the selected first-in-order LED array is energized and provides illumination or emits a light that is subsequently passed though a light filter to block or otherwise significantly reduce blue light emissions which can be seem as being harmful to people during nocturnal operations. The emitted filtered light or illumination could then pass onto the first LED array's respective light detector, each such light detector could comprise a photoresistor and photocell and the like generally connected in parallel. Light upon these devices could cause an electrical current to be sent onto the light analyzer. The photoresistor could allow secondary circuit B's electrical current to pass through the photoresistor while photodetector (e.g., acts like a solar panel) could transforms the light into an electrical current that also directed towards the connected light analyzer. The photodetector and a photoresistor may be seen as redundancy light measuring units for each other in that either the photodetector or the photoresistor may send sufficient current or incoming electrical signal to the light analyzer to prevent electrical geared motor energization.

The light analyzer could further incorporate a potentiometer (e.g., an adjustable resister) that could be used by the operator to adjust the nominal level of incoming electrical current (e.g., energized LED array's illumination) needed to prevent the activation of the light analyzer and the activation of the rotation electrical switch (e.g., closing of the electrical geared motor's electrical contacts) in activation of the next-in-sequence LED array.)

The second circuit B substantially energizes the light analyzer's electrical contacts for the power lead to the electrical geared motor. As the light analyzer receives sufficient current from either the photodetector or the photoresistor (e.g., indicating the selected LED array is working properly when energized), the light analyzer holds the geared motor's power contacts open. This action prevents the energization of the geared motor, the movement of the rotational arm of the rotation electrical switch and sequentially energization of the next-in-sequence LED array.

In at least one embodiment of the invention, the energization of the second or sequential circuit B could operate one or more fans that move air into and out of vents of the hollow compartment where the LED arrays and other electronic components are located. In this manner, heat emitted created the operating LED array and other electronic components could be dissipated to the self-repairing light bulb's outside or exterior environment.

As this step is substantially completed, the process 100 could proceed to the next step 106, selecting LED array for energization.

In step 106, selecting LED array for energization, as long the currently sequentially selected LED array provides a sufficient amount of light or illumination, the self-repairing light bulb will continue to electrify the selected LED array. However, if the LED array as selected fails during operations to provide sufficient or any illumination then the associated light detector will not issue sufficient current on input signal to the light analyzer. This action will allow the activation (e.g., closing of geared motor electrical contacts) of the rotational electrical switch.

The energized geared electrical motor generally moves the rotational electrical switch's rotational arm around the tracked disc to the next track section. The contact of the energized electrically conductive tip of the rotational arm to the adjacent track section could close the electrical circuit of the next-in-sequence LED array that is electrically connected to the adjacent track section. The next-in-sequence LED array could then be energized and illuminate the respective light detector to allow the passage, the creation, or both, of electrical current (e.g., incoming input signal) to the light analyzer. The electrical current could cause the light analyzer to cut off power to rotation electrical switch's electrical geared motor (e.g., open the electrical contacts). This power down action could hold the rotational arm in electrical contact location upon the isolated track section that is electrically connected to the second-in-sequence LED array.

If the second-in-sequence LED assay then fails to timely illuminate the light bulb, then the light analyzer could instead continue the operation of the rotational electrical switch to cause the energization of the next succeeding (e.g., third) LED assay and so forth until proper self-repairing light bulb illumination is substantially restored.

When the activation of the rotation electrical switch causes the energization of the last or final-in-sequence LED assay, a last LED array activation alert system could be energized as well. The last LED array activation alert system could comprise a circuit powered by the final-in-the sequence LED assay or directly by the rotational electrical switch. The final-in-sequence LED assay could comprise an additional illumination source(s) that are substantially produce illumination that is generally separate and distinct from the illumination produced by the activated final-in-sequence LED assay. The additional illumination source(s) could be located either on the self-repairing light bulb's outside surface or next to the translucent covering placed over the hollow compartment containing the LED assays. This additional illumination source be a LED (e.g., a blue or other suitably colored LED) that when energized could be observed by the operator during light bulb operations to be understood that the final-in-the sequence LED assay has been activated and the light bulb should be removed for replacement, refurbishment, or both.

When this step is substantially completed, the process 100 could proceed to step 108, deactivating the light bulb.

In step 108, deactivating the light bulb, when bulb illumination is no longer required, the energy to the bulb socket can be discontinued thereby terminating power (cutting off the household current to the self-repairing light bulb) to first and second circuits A and B for LED arrays and rotation electrical switch system. As noted above, self-repairing light bulb is configured so that the de-energization does not trigger LED array sequential activation process during light bulb powering up or powering down activities.

If the switch arm has activated the final LED array in sequential order and that final LED array has failed (provide insufficient or no illumination) then the resultant powering the rotational electrical switch could bring the rotational arm into contact with the kill switch. This activation of the kill switch could cut power to the electrical geared motor, locating the electrically conductive tip upon the track disc in a manner that none of the LED arrays are energized. Alternatively, when activated, the geared motor kill switch could interrupt (e.g., shut down) the second circuit B's power to all the electrical/electronic components in that circuit or alternatively cutoff household power to the self-repairing light bulb. When this step is substantially completed, the process 100 could proceed back to step 104.

CONCLUSION

Although the description above contains many specifications, these should not be construed as limiting the scope of the invention but as merely providing illustrations of some of the presently preferred embodiments of this invention. Thus, the scope of the invention should be determined by the appended claims and their legal equivalents rather than by the examples given.

What is claimed is:

1. A self-repairing light bulb comprising:

(A) a light bulb body having a portion that is at least translucent, further forming a hollow interior for containing a set of illumination arrays, one or more light detectors, a light analyzer, a programmable electromechanical controller and a last illumination array activation alert system;

(B) wherein: each illumination array of the set of illumination arrays comprises several light emitting sources clustered together, the set of illumination arrays are further positioned within the hollow interior to project a light through the portion of the body that is at least translucent;

(C) the one or more light detectors being proximate to the set of illumination arrays to detect a set minimum level of illumination as issued from an energized illumination array from the set of illumination arrays, the one or more light detectors are electrically connected to the light analyzer;

(D) the light analyzer electrically connects to the programmable electro-mechanical controller to activate the programmable electro-mechanical controller when the energized illumination array fails to provide the set minimum level of illumination when the self-repairing light bulb is suitably energized;

(E) the programmable electro-mechanical controller when activated, energizes one illumination array at a time from the set of illumination arrays; and (F) the last illumination array activation alert system that is distinct from the set of illumination arrays, last illumination array activation alert system being activated when a last-in-sequence to be energized illumination array from the set of illumination arrays is energized.

2. The self-repairing light bulb of claim 1, wherein each light detector of the one or more light detectors is placed proximate to a respective illumination array.

3. The self-repairing light bulb of claim 1, wherein the programmable electro-mechanical controller comprises a controller body holding a geared electrical motor that operates a rotational electrical switch that sequentially energizes the set of illumination arrays.

4. The self-repairing light bulb of claim 3, wherein only one illumination array of the set of illumination arrays is suitably energized at a time in a sequential pattern.

5. The self-repairing light bulb of claim 3, wherein the rotation switch comprises a rotatable arm movably located over a tracked disc, one end of the rotatable arm being electrically conductive and connected to a power source, the tracked disc having a circular electrical track running proximate along a circumference of the tracked disc.

6. The self-repairing light bulb of claim 5, wherein the rotatable arm being configured to move the electrically conductive end along the circular electrical track.

7. The self-repairing light bulb of claim 5, wherein the circular electric track comprises a set of track sections with each track section electrically isolated from the remaining track sections.

8. The self-repairing light bulb of claim 7, wherein each track section is electrically connected to a respective illumination array of the set of illumination arrays.

9. The self-repairing light bulb of claim 1, wherein the last illumination array activation alert system is electrically connected to an electrical circuit that powers the last-in-sequence to be energized illumination array.

10. The light bulb of claim 1, wherein the last illumination array activation alert system is an electrical light source being placed on the bulb body and the electrical light source when energized to emit a light that is separate and distinct from a light issued by the last-in-sequence to be energized illumination array.

11. The light bulb of claim 1, wherein the set of illumination arrays, the one or more light detectors, the light analyzer, the programmable electro-mechanical controller and the last illumination array activation alert system are organized into two electrical circuits, a first electrical circuit provides power to the set of illumination arrays and a second electrical circuit controls the energization of the individual illumination arrays of the set of illumination arrays in a sequential pattern.

12. The light bulb of claim 1, further comprising a light filter placed proximate to the set of illumination arrays, the light filter is further configured to remove blue light from the light emitted from the set of illumination arrays.

13. A method of operating a self-repairing light bulb, comprising:

(A) providing a self-repairing light bulb comprising a light bulb body having a portion of the body that is at least translucent, the light bulb body further forming a hollow interior for containing a set of illumination arrays, a set of light detectors, a light analyzer, a programmable electro-mechanical controller and a last illumination array activation alert system, wherein each light detector of the set of light detectors is placed proximate to a respective light array of the set of illumination arrays, each light detector is electrically connected to the light analyzer; the light analyzer electrically connects to a geared motor of the programmable electro-mechanical controller, a rotational electrical switch of the programmable electro-mechanical controller is driven by the geared motor, the rotation electrical switch further electrically connects to individual illumination arrays of the set of illumination arrays;

(B) detecting less than a set minimum amount of illumination from the set of illumination arrays by the one or more light detectors;

(C) receiving an electrical input by the light analyzer from one or more light detectors that activates the light analyzer to energize the geared motor;

(D) moving the rotational arm of the rotational electrical switch to energize one illumination array of the multiple illumination arrays at a time in a sequential pattern; and (E) activating the last illumination array warning system when a last-in-sequence illumination array is energized.

14. The method of claim 13, wherein the energizing the last illumination array activation alert system further comprises a step of notifying the self-repairing light bulb operator that the last-in-sequence illumination array has been selected for energization by the self-repairing light bulb and the self-repairing light bulb should be replaced in a timely manner.

15. The method of claim 13, wherein the energizing the last illumination array activation alert system further comprises a step of energizing a light source that is distinct and separate from the set of illumination arrays.

16. The method of claim 13, wherein the energizing the last illumination array warning system further comprises a step of providing an illumination that is separate and distinct from the illumination provided by the set of illumination arrays.

17. The method of claim 13, wherein the moving the rotational arm of the rotational electrical switch further comprises a step of moving an electrical contact point along isolated track sections of the electrical track.

18. The method of claim 17, wherein the moving an electrical contact point further comprises a step of energizing an isolated track section to electrify an illumination array connected to the isolated track section.

19. The method of claim 13, further comprising a step of activating a geared motor kill switch after an energized last-in-sequence illumination array fails to provide the set minimum amount of illumination.

20. The method of claim 13, further comprising a step of moving air between a light bulb body's exterior environment and the hollow interior.

* * * * *